US007089902B2

(12) United States Patent
Sato et al.

(10) Patent No.: US 7,089,902 B2
(45) Date of Patent: Aug. 15, 2006

(54) SINTERED ALLOY VALVE SEAT AND METHOD FOR MANUFACTURING THE SAME

(75) Inventors: Kenichi Sato, Shimotsuga-gun (JP); Arata Kakiuchi, Shimotsuga-gun (JP); Teruo Takahashi, Shimotsuga-gun (JP); Masao Ishida, Wako (JP); Hiroyuki Oketani, Wako (JP)

(73) Assignees: Nippon Piston Ring Co., Ltd., Satiama (JP); Honda Motor Co., Ltd., Tokyo (JP)

( * ) Notice: Subject to any disclaimer, the term of this patent is extended or adjusted under 35 U.S.C. 154(b) by 214 days.

(21) Appl. No.: 10/752,090

(22) Filed: Jan. 7, 2004

(65) Prior Publication Data

US 2004/0187830 A1 Sep. 30, 2004

(30) Foreign Application Priority Data

Jan. 10, 2003 (JP) ..... 2003-004489
Nov. 12, 2003 (JP) ..... 2003-412900

(51) Int. Cl.
*F02N 3/00* (2006.01)
*B21K 1/24* (2006.01)

(52) U.S. Cl. ..... 123/188.8; 29/888.44

(58) Field of Classification Search ..... 123/188.8, 123/188.3, 188.2; 29/888.44, 888.42, 888.46; 75/246, 236; 419/6, 14, 16, 38
See application file for complete search history.

(56) References Cited

U.S. PATENT DOCUMENTS 4,424,953 A * 1/1984 Takagi et al. ..... 251/368
4,546,737 A * 10/1985 Kazuoka et al. ..... 123/188.8
4,671,491 A * 6/1987 Kuroishi et al. ..... 251/368
5,666,632 A * 9/1997 Maulik ..... 419/6
6,139,598 A * 10/2000 Narasimhan et al. ..... 75/246

FOREIGN PATENT DOCUMENTS

JP 61-10644 3/1986
JP 2000-54087 2/2000
JP 2000-160307 6/2000

* cited by examiner

*Primary Examiner*—Tony M. Argenbright
*Assistant Examiner*—Hyder Ali
(74) *Attorney, Agent, or Firm*—Crowell & Moring LLP

(57) ABSTRACT

A valve seat, press-fitted into a cylinder head of an internal combustion engine, containing an iron-based sintered alloy, includes a valve-seating section and a head-seating section. The valve-seating section and the head-seating section are monolithically formed by a sintering process and form a double layer structure. The valve-seating section includes a first iron-based sintered alloy member that has a porosity of 10 to 25 percent by volume and a sintered density of 6.1 to 7.1 g/cm$^3$ and contains hard particles dispersed in a matrix. The head-seating section includes a second iron-based sintered alloy member that has a porosity of 10 to 20 percent by volume and a sintered density of 6.4 to 7.1 g/cm$^3$.

7 Claims, 5 Drawing Sheets

SINTERED ALLOY VALVE SEAT AND METHOD FOR MANUFACTURING THE SAME

BACKGROUND OF THE INVENTION

1. Field of the Invention

The present invention relates to valve seats for internal combustion engines. The present invention particularly relates to a valve seat formed by an iron-based sintered alloy, having high abrasion resistance and also relates to a method for manufacturing such a valve seat.

2. Description of the Related Art

Valve seats, which are press-fitted into cylinder heads of engines, have been used for preventing a combustion gas from leaking and used for cooling valves. Such valve seats must have high heat resistance, abrasion resistance, and corrosion resistance and also have low opposite aggressibility so as to avoid wearing valves, which are opposite members.

For automobile engines, demands have been recently made for improvement in life, power, emission gas, fuel efficiency, and the like. Therefore, it is necessary that the valve seats for such automobile engines can be used in more severe environments than ever. Thus, the valve seats must be further improved in heat resistance and abrasion resistance.

In order to meet such requirements, Japanese Unexamined Patent Application Publication No. 2000-54087 (hereinafter referred to as Patent Document 1) discloses the following material for value seats: an iron-based sintered alloy material, containing Cr—Mo—Si—Co alloy particles dispersed as hard particles in the matrix in the amount of 10–30% on an area basis, and its porosity being 1–10% on a volume basis. A method for manufacturing the iron-based sintered alloy material includes a forming step for filling raw material powder into a metal mold to compact the packed powder to form a green compact, a first sintering step for heating the green compact at 900–1,200° C. in a protective atmosphere to obtain a primary sintered body, a re-pressing/forging step for re-pressing the primary sintered body to obtain a re-pressed compact or forging the primary sintered body to obtain a forged compact, and a second sintering step for heating the re-pressed compact or forged compact at 1,000–1,200° C. in a protective atmosphere. According to the technique disclosed in Patent Document 1, a high-density sintered product, which is an iron-based sintered alloy material having improved high-temperature strength and thermal conductivity, can be obtained.

Japanese Unexamined Patent Application Publication No. 2000-160307 (hereinafter referred to as Patent Document 2) discloses a method for manufacturing a powder metallurgical component, which is fit for a valve seat insert. This method includes a step for press-molding a mixed powder to form a green compact having substantially a reticulated shape and a step for sintering the green compact. The mixed powder contains 15–30% of a valve steel powder, 0–10% of Ni powder, 0–5% of Cu powder, 5–15% of a ferroalloy powder, 0–15% of a tool steel powder, 0.5–5% of a solid lubricant, 0.5–2.0% of graphite, and 0.3–1.0% of a primary lubricant on a mass basis, the remainder being substantially a low-alloy steel powder. The untreated compact has a density of 6.7–7.0 g/cm$^3$, preferably 6.8–7.0 g/cm$^3$, and most preferably 6.9 g/cm$^3$. According to the technique disclosed in Patent Document 2, the powder metallurgical component having a relatively high density can be obtained by a sintering process including a single pressing step. The component further has high abrasion resistance, heat resistance, creep strength, fatigue strength, corrosion resistance, and machinability.

Japanese Examined Patent Application Publication No. 61-10644 (hereinafter referred to as Patent Document 3) discloses a sintered alloy valve seat, monolithically formed by a sintering process, having a double layer structure consisting of a surface layer portion and a base layer portion. The surface layer portion includes a working face repeatedly knocked by a valve face, and the base layer portion is in contact with the bottom of a press-fitting hole of a cylinder head. The surface layer portion has a porosity of 5–20% and the base layer portion has a porosity of 5% or less. The sintered alloy valve seat is fit for a cast-iron cylinder head.

In the technique disclosed in Patent Document 1, the step for re-pressing or forging the primary sintered body and the secondary sintering step are necessary to obtain the high-density sintered compact having a porosity of 1–10%. Therefore, there is a problem in that the manufacturing process is complicated and manufacturing cost is high. In the technique disclosed in Patent Document 3, a step of subjecting the sintered compact to compression-forging by a rotary forging process and a step of re-sintering the resulting sintered compact are necessary to decrease the porosity of the base layer portion; hence, there is a problem in that the manufacturing process is complicated and manufacturing cost is high.

On the other hand, in the technique disclosed in Patent Document 2, the powder metallurgical component having a relatively high density can be obtained by the method including a single molding step and a single sintering step; however, a step for increasing the density is complicated. Therefore, there is a problem in that manufacturing cost is high.

In recent years, for gasoline engines, demands for high power have been growing. Therefore, during the operation of the engines, thermal loads applied to valve seats are greatly increased and impact loads applied to the valve seats by valves are also greatly increased.

Under such conditions, adhesive wear readily occurs on the surfaces of valves and valve seats; hence, fresh surfaces functioning as sliding surfaces are repeatedly formed. Therefore, there is a problem in that the valves and valve seats are seriously worn.

SUMMARY OF THE INVENTION

The present invention has been made to solve the above problems advantageously. It is an object of the present invention to provide a valve seat containing an iron-based sintered alloy and a method for manufacturing such a valve seat. The valve seat can cope with severe operating conditions of recent gasoline engines, has satisfactory high-temperature strength, creep strength, fatigue strength, and abrasion resistance, and has a satisfactory property of forming iron oxide.

In order to achieve the above object, the inventors have intensively investigated various factors having an effect on improvement in abrasion resistance of valve seats. As a result, the inventors have found that the amount of iron oxide formed on a sliding surface of a valve seat closely correlates to the abrasion resistance under operating conditions of recent internal combustion engines, particularly gasoline engines, the iron oxide being formed due to a thermal load generated during the operation of an internal combustion engine. According to the investigation of the inventors, since the valve seat with high density contains a very small number of pores, a small amount of iron oxide is formed on the sliding surface of the valve seat depending on the thermal load generated during the operation of the internal combustion engine and therefore adhesive wear occurs on the sliding surface before a sufficient amount of iron oxide is formed, whereby the valve and valve seat are seriously worn. From the investigation results, the inventors have found that the valve seat must have a relatively small density in order to prevent the adhesive wear from occurring and in order to enhance the abrasion resistance of the valve seat under operating conditions of recent gasoline engines. Furthermore, the inventors have found that the mechanical strength, which depends on the density of a sintered compact, has a small effect on the abrasion resistance.

On the basis of such findings, the inventors have devised a valve seat having a double layer structure consisting of a first section on which a valve is seated (hereinafter referred to as a valve-seating section) and a second section on which a head is seated (hereinafter referred to as a head-seating section). These sections contain different materials, that is, the valve-seating section includes a first iron-based sintered alloy member that prevents the adhesive wear from occurring and has satisfactory abrasion resistance and the head-seating section includes a second iron-based sintered alloy member having high strengths such as high-temperature strength, creep strength, and fatigue strength, which are essential for gasoline engines. The first iron-based sintered alloy member of the valve-seating section has a relatively small sintered density such that micropores remain therein. The micropores promote the formation of iron oxide due to a thermal load generated during the operation of internal combustion engines, whereby the adhesive wear can be prevented from occurring and satisfactory abrasion resistance can be obtained. On the other hand, the second iron-based sintered alloy member of the head-seating section is formed using powder having satisfactory compactibility, whereby this alloy has high-temperature strength and the like sufficient for gasoline engines even if the alloy is compacted at a relatively low pressure.

The scope of the present invention will now be described.

According to the present invention, a valve seat, press-fitted into a cylinder head of an internal combustion engine, containing an iron-based sintered alloy includes a valve-seating section and a head-seating section. The valve-seating section and head-seating section are monolithically formed by a sintering process and form a double layer structure. The valve-seating section includes a first iron-based sintered alloy member that has a porosity of 10 to 25 percent by volume and a sintered density of 6.1 to 7.1 g/cm$^3$ and contains hard particles dispersed in a matrix phase. The head-seating section includes a second iron-based sintered alloy member that has a porosity of 10 to 20 percent by volume and a sintered density of 6.4 to 7.1 g/cm$^3$.

In the above valve-seating section, the hard particles contain at least one selected from the group consisting of C, Cr, Mo, Co, Si, Ni, S, and Fe, and the content of the hard particles in the first iron-based sintered alloy member is 5 to 40 percent by area.

In the valve-seating section, the matrix phase and hard particles form a base portion; the base portion contains 10.0 to 40.0 percent by mass of at least one selected from the group consisting of Ni, Cr, Mo, Cu, Co, V, Mn, W, Si, S, and C, the Ni content being 2.0 to 23.0%, the Cr content being 0.4 to 15.0%, the Mo content being 3.0 to 15.0%, the Cu content being 0.2 to 3.0%, the Co content being 3.0 to 15.0%, the V content being 0.1 to 0.5%, the Mn content being 0.1 to 0.5%, the W content being 0.2 to 6.0%, the Si content being 0.1 to 1.0%, the S content being 0.1 to 1.0%, the C content being 0.8 to 2.0% on a mass basis, the balance being substantially Fe; and the matrix phase of the second iron-based sintered alloy member contains 0.3–15.0 percent by mass of at least one selected from the group consisting of C, Ni, Cr, Mo, Cu, Co, V, and Mn, the remainder being substantially Fe.

In the valve-seating section and the head-seating section, the first and second iron-based sintered alloy members further contain 0.3 to 3.5 percent by area of solid lubricant particles dispersed in the matrix phase.

The solid lubricant particles contain at least one selected from the group consisting of zinc stearate, a sulfide, and a fluoride.

According to the present invention, a method for manufacturing a valve seat containing an iron-based sintered alloy includes a forming step of filling a first raw material powder for forming a valve-seating section and a second raw material powder for forming a head-seating section into a metal mold one after another such that the first and second raw material powders form a double layer structure and then compacting the resulting first and second raw material powders to form a green compact consisting of two layers; and a sintering step of heating the resulting green compact in a protective atmosphere to obtain a sintered body having a double layer construction. The first raw material powder contains 20 to 70% of a pure iron powder, 10 to 50% of a first ferroalloy powder, and 5 to 40% of a hard particle powder on a mass basis or further contains 0.2 to 3.0 parts by weight of a solid lubricant powder with respect to 100 parts by weight of the first raw material powder. The pure iron powder, first ferroalloy powder, and hard particle powder or solid lubricant particle powder are blended and mixed. The first ferroalloy powder contains 3 to 30 percent by mass of at least one selected from the group consisting of Ni, Cr, Mo, Cu, Co, V, Mn, W, and C, the balance being substantially Fe. The hard particle powder contains at least one selected from the group consisting of C, Cr, Mo, Co, Si, Ni, S, and Fe. The second raw material powder contains 85% or more of the pure iron powder and 0.3 to 15% of a second ferroalloy powder on a mass basis or further contains 0.2 to 3.0 parts by weight of the solid lubricant powder with respect to 100 parts by weight of the second raw material powder. The pure iron powder and second ferroalloy powder or solid lubricant powder are blended and mixed. The second ferroalloy powder contains at least one selected from the group consisting of C, Ni, Cr, Mo, Cu, Co, V, and Mn. Conditions of the forming step and sintering step are adjusted such that the first iron-based sintered alloy member has a sintered density of 6.1 to 7.1 g/cm$^3$ and a porosity of 10 to 25 percent by volume and the second iron-based sintered alloy member has a sintered density of 6.4 to 7.1 g/cm$^3$ and a porosity of 10 to 20 percent by volume.

In the above method, the first raw material powder contains 0.3 to 15.0 percent by mass of an alloy element powder instead of part or the whole of the ferroalloy powder and the alloy element powder contains at least one selected from the group consisting of Ni, Cr, Mo, Cu, Co, V, Mn, W, and C.

According to the present invention, a valve seat having satisfactory abrasion resistance and iron oxide-forming properties can be readily manufactured at low cost, thereby achieving great advantages in industry. The valve seat of the present invention can endure severe conditions such as high-temperature combustion gas and the like when an internal combustion engine is operated.

BRIEF DESCRIPTION OF THE DRAWINGS

FIG. 2 is an illustration including two optical microscopic photographs.

FIG. 3 is an illustration including two optical micro graphs.

FIG. 4 is an illustration including two optical micrographs.

DESCRIPTION OF THE PREFERRED EMBODIMENTS

Figure 1:
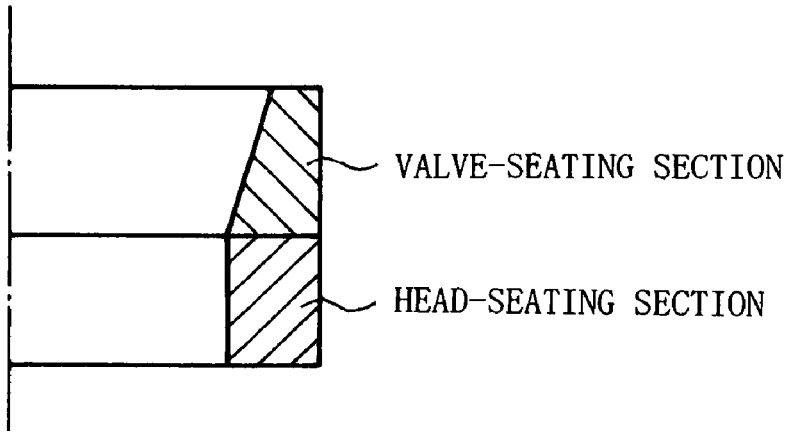
FIG. 1 is a vertical sectional view-schematically showing a configuration of a valve seat according to the present invention.

FIG. 1 shows a valve seat of the present invention. The valve seat includes a valve-seating section and a head-seating section, wherein these sections contain different materials. The valve seat has a double layer structure consisting of the sections monolithically formed by a sintering process. In the valve seat, the valve-seating section is formed by a first iron-based sintered alloy member and the head-seating section is formed by a second iron-based sintered alloy member.

The first iron-based sintered alloy member of the valve-seating section is a sintered body and contains a matrix phase, hard particles dispersed therein, and micropores. The first iron-based sintered alloy member has a porosity of 10–25% on a volume basis and a sintered density of 6.1–7.1 g/cm$^3$. The first iron-based sintered alloy member may further contain solid lubricant particles dispersed in the matrix phase.

The micropores affect the high-temperature strength, fatigue strength, and thermal conductivity. When the porosity is less than 10%, the strengths and thermal conductivity are high; however, the amount of iron oxide formed due to a thermal load generated during the operation of an internal combustion engine is insufficient, the iron oxide being effective in preventing wear. In contrast, when the porosity is more than 25%, the room-temperature strength and high-temperature strength are seriously low. Thus, in the present invention, the porosity is limited within a range of 10 to 25 percent by volume. The porosity used herein is determined by an image analysis method.

The sintered density affects the strength and thermal conductivity. When the sintered density is less than 6.1 g/cm$^3$, the strength is seriously low. In contrast, when the sintered density is more than 7.1 g/cm$^3$, the amount of iron oxide formed due to a thermal load generated during the operation of an internal combustion engine is insufficient. Furthermore, in order to increase the density, a manufacturing process is complicated, thereby increasing manufacturing cost. Thus, in the present invention, the sintered density is limited within a range of 6.1 to 7.1 g/cm$^3$. The sintered density used herein is determined by an Archimedes method.

In the valve-seating section, the first iron-based sintered alloy member containing the matrix phase and hard particles, which form a base portion, preferably contains 10.0–40.0 percent by mass of at least one selected from the group consisting of Ni, Cr, Mo, Cu, Co, V, Mn, W, C, Si, and S. The Ni content is 2.0–23.0%, the Cr content is 0.4–15.0%, the Mo content is 3.0–15.0%, the Cu content is 0.2–3.0%, the Co content is 3.0–15.0%, the V content is 0.1–0.5%, the Mn content is 0.1–0.5%, the W content is 0.2–6.0%, the C content is 0.8–2.0%, the Si content is 0.1–1.0%, and the S content is 0.1–1.0% on a mass basis, and the remainder is substantially Fe.

Ni, Cr, Mo, Cu, Co, V, Mn, W, C, Si, and S contained in the matrix phase and hard particles enhance the abrasion resistance. The matrix phase and hard particles may contain 10.0–40.0%, in total, by mass of at least one selected from the elements.

Ni enhances the hardness and the heat resistance in addition to the abrasion resistance. When the Ni content is less than 2.0 percent by mass, the above advantages cannot be obtained. In contrast, when the Ni content is more than 23.0 percent by mass, the opposite aggressibility is too high for practical use.

Cr contained in both the matrix phase and hard particles enhances the hardness and heat resistance in addition to the abrasion resistance. When the Cr content is less than 0.4 percent by mass, the above advantages cannot be obtained. In contrast, when the Cr content is more than 15.0 percent by mass, the opposite aggressibility is too high.

Mo contained in the matrix phase and hard particles enhances the hardness and heat resistance in addition to the abrasion resistance. When the Mo content is less than 3.0 percent by mass, the above advantages cannot be obtained. In contrast, when the Mo content is more than 15.0 percent by mass, the opposite aggressibility is too high.

Cu reinforces the matrix phase and enhances the hardness in addition to the abrasion resistance. When the Cu content is less than 0.2 percent by mass, the above advantages cannot be obtained. In contrast, when the Cu content is more than 3.0 percent by mass, free Cu is precipitated, whereby the valve seat is caused to stick to the valve in operation.

Co enhances the bonding between the matrix phase and hard particles in addition to the abrasion resistance and heat resistance. When the Co content is less than 3.0 percent by mass, the above advantages cannot be obtained. In contrast, when the Co content is more than 15.0 percent by mass, the opposite aggressibility is too high.

V reinforces the matrix phase and enhances the hardness in addition to the abrasion resistance. When the V content is less than 0.1 percent by mass, the above advantages cannot be obtained. In contrast, when the V content is more than 0.5 percent by mass, the opposite aggressibility is too high.

Mn reinforces the matrix phase and enhances the hardness in addition to the abrasion resistance. When the Mn content is less than 0.1 percent by mass, the above advantages cannot be obtained. In contrast, when the Mn content is more than 0.5 percent by mass, the opposite aggressibility is too high.

W reinforces the matrix phase and enhances the hardness in addition to the abrasion resistance. When the W content is less than 0.2 percent by mass, the above advantages cannot be obtained. In contrast, when the W content is more than 6.0 percent by mass, the opposite aggressibility is too high.

C reinforces the matrix phase and enhances the diffusion during sintering in addition to the abrasion resistance. When the C content is less than 0.8 percent by mass, the above advantages cannot be obtained. In contrast, when the C content is more than 2.0 percent by mass, the opposite aggressibility is too high.

Si reinforces the matrix phase and enhances the abrasion resistance. When the Si content is less than 0.1 percent by mass, the above advantages cannot be obtained. In contrast, when the Si content is more than 1.0 percent by mass, the opposite aggressibility is too high.

S reinforces the matrix phase and enhances the abrasion resistance. When the S content is less than 0.1 percent by mass, the above advantages cannot be obtained. In contrast, when the S content is more than 1.0 percent by mass, the opposite aggressibility is too high.

In the first iron-based sintered alloy member, when the total content of the above elements is less than 10.0 percent by mass, the hardness and high-temperature properties of the matrix are too low for practical use. The high-temperature properties include high-temperature strength and creep strength. In contrast, when the total content is more than 40.0 percent by mass, the opposite aggressibility is too high for practical use. Thus, in the present invention, the total content of the above elements is preferably limited within a range of 10.0 to 40.0 percent by mass.

In the matrix phase of the first iron-based sintered alloy member, the remainder except for the above elements is substantially Fe.

The hard particles dispersed in the matrix phase of the first iron-based sintered alloy member enhance the abrasion resistance. In the present invention, the content of the hard particles is 5–40% on an area basis. When the hard particle content is less than 5%, the above advantage cannot be obtained. In contrast, when the content is more than 40%, the opposite aggressibility is too high for practical use. Thus, in the present invention, the content is limited within a range of 5 to 40%. The content is preferably 10–30%.

In the first iron-based sintered alloy member of the valve-seating section, the hard particles dispersed in the matrix phase preferably contain at least one selected from the group consisting of C, Cr, Mo, Co, Si, Ni, S, and Fe. Furthermore, the hard particles preferably have a Vickers hardness Hv ranging from 600 to 1,200. When the hardness of the hard particles is less than HV600, the abrasion resistance is too low for practical use. In contrast, when the hardness is more than HV1,200, the toughness is too low and therefore there is a problem in that chipping or cracking occurs.

The hard particles include, for example, Cr—Mo—Co intermetallic compound particles, Ni—Cr—Mo—Co intermetallic compound particles, Fe—Mo alloy particles, Fe—Ni—Mo—S alloy particles, and Fe—Mo—Si alloy particles.

The Cr—Mo—Co intermetallic compound particles contain 5.0–20.0% of Cr and 10.0–30.0% of Mo on a mass basis, the remainder being substantially Co. The Ni—Cr—Mo—Co intermetallic compound particles contain 5.0–20.0% of Ni, 15.0–30.0% of Cr, 17.0–35.0% of Mo on a mass basis, the remainder being substantially Co. The Fe—Mo alloy particles contain 50.0–70.0% of Mo on a mass basis, the remainder being substantially Fe. The Fe—Ni—Mo—S alloy particles contain 50.0–70.0% of Ni, 20.0–40.0% of Mo, and 1.0–5.0% of S on a mass basis, the remainder being substantially Fe. The Fe—Mo—Si alloy particles contain 5.0–20.0% of Si and 20.0–40.0% of Mo on a mass basis, the remainder being substantially Fe.

The first iron-based sintered alloy member of the valve-seating section may contain the solid lubricant particles dispersed in the matrix phase in addition to the hard particles. The solid lubricant particles enhance the machinability and abrasion resistance and decrease the opposite aggressibility. The solid lubricant particles preferably contain at least one selected from the group consisting of a sulfide such as MnS or $MOS_2$, and a fluoride such as $CaF_2$ or contain a mixture thereof. The content of the solid lubricant particles is preferably 0.3–3.5% on an area basis. When the content is less than 0.3%, the machinability is too low due to the small content, whereby sticking is caused and the abrasion resistance is deteriorated. In contrast, when the content exceeds 3.5%, the advantages are saturated, that is, the advantages are not in proportion to the content. Thus, the content of the solid lubricant particles is preferably limited within a range of 0.3 to 3.5%.

For the structure of the matrix phase of the valve-seating section, pearlite occupies 30–60% of the area of the matrix phase and high-alloy diffusion phase occupies 40–70% of the area in preferable when the area of the matrix phase except for the hard particles is normalized to 100%.

On the other hand, the second iron-based sintered alloy member of the head-seating section is a sintered body and contains a matrix phase and pores. The second iron-based sintered alloy member has a porosity of 10–20% on a volume basis and a sintered density of 6.4–7.1 g/cm$^3$ and may further contain solid lubricant particles dispersed in the matrix phase.

The second iron-based sintered alloy member containing the pores has a porosity of 10–20%. The amount of the pores affects the strength of the second iron-based sintered alloy member. When the porosity is less than 10%, the strength is sufficiently high; however, a step of increasing the density of the second iron-based sintered alloy member is complicated, thereby significantly increasing manufacturing cost. In contrast, when the porosity is more than 20%, the second iron-based sintered alloy member has an extremely low strength. Thus, in the present invention, the porosity is limited within a range of 10 to 20% on a volume basis.

The second iron-based sintered alloy member has a sintered density of 6.4–7.1 g/cm$^3$ as described above. The sintered density correlates with the strength and thermal conductivity of the second iron-based sintered alloy member. When the sintered density is less than 6.4 g/cm$^3$, the strength is extremely low and therefore the head-seating section cannot have a desired strength. In contrast, when the sintered density is more than 7.1 g/cm$^3$, a step of increasing the density is complicated, thereby significantly increasing manufacturing cost. Thus, in the present invention, the sintered density is limited within a range of 6.4 to 7.1 g/cm$^3$.

In the second iron-based sintered alloy member of the head-seating section of the valve seat according to the present invention, the matrix phase preferably contains 0.3–15 percent by mass of at least one selected from the group consisting of C, Ni, Cr, Mo, Cu, Co, V, and Mn, the balance being substantially Fe.

The above elements enhance the strength of the second iron-based sintered alloy member. When the total content of the elements is less than 0.3 percent by mass, the head-seating section cannot have a desired strength. In contrast, when the total content of the elements is more than 15 percent by mass, the advantage is saturated, that is, the advantage is not in proportion to the content. Thus, the total content of the elements is preferably limited within a range of 0.3 to 15 percent by mass.

In the matrix phase of the second iron-based sintered alloy member of the head-seating section, the remainder except for the above elements is substantially Fe.

In the present invention, the second iron-based sintered alloy member may further contain the solid lubricant particles dispersed in the matrix phase. The solid lubricant particles enhance the machinability of the second iron-based sintered alloy member. The solid lubricant particles preferably contain at least one selected from the group consisting of a sulfide such as MnS or $MOS_2$, and a fluoride such as $CaF_2$ or contain a mixture thereof. The content of the solid lubricant particles in the matrix phase of the second iron-based sintered alloy member is preferably 0.3–3.5% on an area basis. When the content is less than 0.3%, the machinability is too low due to the small content. In contrast, when the content exceeds 3.5%, the advantage is saturated, that is, the advantage is not in proportion to the content. Thus, the content of the solid lubricant particles is preferably limited within a range of 0.3 to 3.5% on an area basis.

A method for manufacturing a valve seat of the present invention will now be described.

A first raw material powder for forming the valve-seating section is prepared so as to obtain the same composition as that of the matrix portion of the first iron-based sintered alloy material and a second raw material powder for forming the head-seating section is prepared so as to obtain the same composition as that of the matrix phase of the second iron-based sintered alloy member.

The first raw material powder is preferably prepared by mixing and kneading the following ingredient powders so as to obtain the same composition as that of the matrix portion including the matrix phase and hard particles: 20–70% of a pure iron powder, 10–50% of a ferroalloy powder, and 5–40% of a hard particle powder on a mass basis with respect to the total amount of the first raw material powder (the total amount of the pure iron powder, ferroalloy powder, and hard particle powder). The ferroalloy powder contains at least one selected from the group consisting of Ni, Cr, Mo, Cu, Co, V, Mn, W, and C, and the total content of those elements is 3–30 percent by mass, the remainder being substantially Fe. The hard particle powder contains at least one selected from the group consisting of C, Cr, Mo, Co, Si, Ni, S, and Fe. Furthermore, 0.2–3.0 parts by weight of a first solid lubricant particle powder may be blended with 100 parts by weight of the first raw material powder. Furthermore, an alloy element powder may be contained in the first raw material powder instead of part or the whole of the ferroalloy powder, wherein the amount of the alloy element powder is 0.3–15 percent by mass with respect to the total amount of first raw material powder. The alloy element powder contains at least one selected from the group consisting of Ni, Cr, Mo, Cu, Co, V, Mn, W and C. The first raw material powder may further contain a lubricant such as zinc stearate or the like.

When the content of the pure iron powder in the first raw material powder is less than 20 percent by mass, the amount of iron oxide, which is effective in enhancing the abrasion resistance, is insufficient and therefore the abrasion resistance is low. In contrast, when the content is more than 70 percent by mass, the amount of iron oxide is sufficient; however, the hardness of the matrix phase of the first iron-based sintered alloy member is insufficient and therefore the abrasion resistance is low in an initial operation stage in which iron oxide has not been formed.

The ferroalloy powder is contained in the first raw material powder in order to enhance the hardness and high-temperature strength of the matrix of the first iron-based sintered alloy member. When the content of the ferroalloy powder is less than 10 percent by mass, the above advantages cannot be obtained. In contrast, when the content is more than 50 percent by mass, the advantages are saturated, that is, the advantages are not in proportion to the content; hence, such a high content is not cost-effective. The ferroalloy powder contains at least one selected from the group consisting of Ni, Cr, Mo, Cu, Co, V, Mn, W, and C, and the total content of those elements is 3–30 percent by mass, the remainder being substantially Fe. When the total content of those elements in the ferroalloy powder is less than 3 percent by mass, the above advantages cannot be obtained. In contrast, when the content is more than 30 percent by mass, the advantages are saturated, that is, the advantages are not in proportion to the content; hence, such a high content is not cost-effective.

The alloy element powder containing at least one selected from the group consisting of Ni, Cr, Mo, Cu, Co, V, Mn, W and C is contained in the first raw material powder instead of part or the whole of the ferroalloy powder according to needs in order to enhance the hardness and high-temperature strength of the matrix phase. When the content of alloy element powder is less than 0.3 percent by mass, the hardness and high-temperature strength are low and therefore the abrasion resistance is insufficient. In contrast, when the content is more than 15 percent by mass, the advantages are saturated, that is, the advantages are not in proportion to the content.

The hard particle powder containing at least one selected from the group consisting of C, Cr, Mo, Co, Si, Ni, S, and Fe is contained in the first raw material powder in order to enhance the abrasion resistance of the valve-seating section. When the content of the hard particle powder is less than 5 percent by mass, the above advantage cannot be obtained. In contrast, when the content is more than 40 percent by mass, the opposite aggressibility is too high.

The solid lubricant particle powder is contained in the first raw material powder according to needs in order to enhance the machinability and abrasion resistance and in order to lower the opposite aggressibility. When the content of the solid lubricant particle powder is less than 0.2 parts by weight with respect to 100 parts by weight of the first raw material powder, the machinability and abrasion resistance are low. In contrast, when the content is more than 3.0 parts by weight, the advantages are saturated, that is, the advantages are not in proportion to the content.

The above pure iron powder, hard particle powder, and ferroalloy powder and/or alloy element powder are blended with each other at a predetermined ratio, and then mixed and kneaded, thereby preparing the first raw material powder for the valve-seating section. The first raw material powder may further contain a predetermined amount of the solid lubricant particle powder.

On the other hand, the second raw material powder for the head-seating section is preferably prepared by blending and mixing the pure iron powder and alloy element powder such that the same composition as that of the matrix phase of the head-seating section can be obtained. The content of the pure iron powder is preferably 85 percent by mass or more. The content of the alloy element powder, which contains at least one selected from the group consisting of C, Ni, Cr, Mo, Cu, Co, V, and Mn, preferably ranges from 0.3 to 15 percent by mass. Furthermore, 0.2–3.0 parts by weight of the solid lubricant particle powder may be added to the 100 parts by weight of the second raw material powder.

When the content of the pure iron powder in the second raw material powder is less than 85 percent by mass, the compactibility of the second raw material powder is low, that is, a green compact forming with the second raw material powder has a small density; hence, the sintered density is low. Therefore, the strength of the head-seating section is insufficient for valve seats for internal combustion engines.

The alloy element powder, which contains at least one selected from the group consisting of C, Ni, Cr, Mo, Cu, Co, V, and Mn, is contained in the second ingredient powder in order to enhance the strength of the matrix of the second iron-based sintered alloy member. When the content of the alloy element powder is less than 0.3 percent by mass, the advantage is insufficient. In contrast, when the content is more than 15 percent by mass, the advantage is not in proportion to the content.

The second raw material powder as well as the first raw material powder preferably contains the solid lubricant powder. The solid lubricant particle powder is used to enhance the machinability and abrasion resistance of the head-seating section and used to lower the opposite aggressibility. When the content of the solid lubricant particle powder is less than 0.2 parts by weight with respect to 100 parts by weight of the second raw material powder, the machinability and abrasion resistance are low. In contrast, when the content exceeds 3.0 parts by weight, the advantages are saturated, that is, the advantages are not in proportion to the content.

The first raw material powder and second raw material powder are filled into a metal mold one after another such that they form a double layer structure. The resulting powders are subjected to a forming step of compacting the powders with a molding press to form a green compact. The green compact is then subjected to a sintering step of heating the green compact at 1,000–1,200° C. preferably in a protective atmosphere such as a vacuum atmosphere or a gas obtained by the decomposition of ammonia to obtain a sintered body. The obtained sintered body is machined by a cutting or grinding process into the valve seat, having a predetermined size and shape, for internal combustion engines.

In the present invention, the conditions of the forming step and sintering step are preferably adjusted such that the valve-seating section has a sintered density of 6.1–7.1 g/cm$^3$ and a porosity of 10–25 percent by volume. In the forming step, in order to achieve such a density, part of the green compact for forming the valve-seating section preferably has a density of 6.2–7.3 g/cm$^3$. When the sintered density and porosity of the valve-seating section are controlled within the above ranges, the sintered density and porosity of the head-seating section can be also controlled within predetermined ranges.

EXAMPLES

A pure iron powder, hard particle powder, and ferroalloy powder and/or alloy element powder were blended at a ratio shown in Table 1, the types of those powders being shown in Table 1. Furthermore, a predetermined amount (parts by weight) of a solid lubricant particle powder was added to 100 parts by weight of the mixture of the pure iron powder, hard particle powder, and ferroalloy powder and/or alloy element powder, and the resulting mixture was mixed and then kneaded. Thereby, first raw material powders for forming valve-seating sections and second raw material powders for forming head-seating sections were obtained. The content of the pure iron powder, hard particle powder, and ferroalloy powder and/or alloy element powder except for the solid lubricant particle powder is represented by percent by mass. Sample 18, which is a comparative example, does not contain the solid lubricant particle powder.

TABLE 1

| | | Composition of Ingredient Powder (% by mass) | | | | | | | Solid Lubricant Particle Powder | | |
|---|---|---|---|---|---|---|---|---|---|---|---|
| | | Pure Iron Powder | Ferroalloy Powder | | Alloy Element Powder | | Hard Particle Powder | | | | Green Compact Density |
| Samples | Section | Content | Type* | Content | Element | Content | Type** | Content | Type*** | Content (parts by weight)**** | (g/cm$^3$) |
| 1 | VSS(1) | 39.0 | C | 45.0 | 1.0% C | 1.0 | d | 15.0 | II | 1.0 | 6.95 |
| | HSS(2) | 97.0 | — | — | 2.0% Cu and 1.0% C | 3.0 | — | — | I | 1.0 | 7.10 |
| 2 | VSS(1) | 43.9 | B | 45.0 | 1.1% C | 1.1 | a | 10.0 | I | 1.5 | 6.65 |
| | HSS(2) | 97.5 | — | — | 1.0% Ni and 1.0% C | 2.0 | — | — | I | 1.0 | 7.15 |
| 3 | VSS(1) | 69.8 | — | — | 6.0% Ni, 3.0% Co, and 1.2% C | 10.2 | b | 20.0 | I | 0.5 | 6.65 |
| | HSS(2) | 97.5 | — | — | 1.5% Cu and 1.0% C | 2.5 | — | — | I | 0.5 | 7.15 |
| 4 | VSS(1) | 65.8 | — | — | 6.0% Ni, 4.0% Co, 3.0% Mo, and 1.2% C | 14.2 | b | 20.0 | II | 1.0 | 6.60 |
| | HSS(2) | 96.8 | — | — | 1.5% Ni, 0.5% Co, and 1.2% C | 3.2 | — | — | II | 1.0 | 7.05 |
| 5 | VSS(1) | 40.9 | A | 40.0 | 1.1% C | 1.1 | c | 18.0 | I | 1.5 | 6.55 |
| | HSS(2) | 95.8 | — | — | 1.0% Ni, 2.0% Cu, and 1.2% C | 4.2 | — | — | I | 1.0 | 6.85 |
| 6 | VSS(1) | 65.8 | — | — | 6.0% Ni, 4.0% Co, 3.0% Cu, and 1.2% C | 14.2 | c | 20.0 | II | 1.0 | 6.45 |
| | HSS(2) | 97.9 | — | — | 1.0% Ni and 1.1% C | 2.1 | — | — | I | 1.0 | 6.85 |
| 7 | VSS(1) | 22.0 | D | 45.0 | 1.0% C | 1.0 | d | 32.0 | II | 1.0 | 6.50 |
| | HSS(2) | 97.8 | — | — | 1.0% Cu and 1.2% C | 2.2 | — | — | I | 1.0 | 6.85 |
| 8 | VSS(1) | 65.8 | E | 15.0 | 1.2% C | 1.2 | d | 18.0 | II | 2.0 | 6.45 |
| | HSS(2) | 97.7 | — | — | 1.0% Cu and 1.3% C | 2.3 | — | — | I | 1.0 | 6.60 |
| 9 | VSS(1) | 65.0 | F | 12.0 | 1.0% C | 1.0 | a | 22.0 | I | 1.0 | 6.45 |
| | HSS(2) | 97.3 | — | — | 1.5% Cu and 1.2% C | 2.7 | — | — | I | 1.0 | 6.50 |
| 10 | VSS(1) | 38.7 | B | 40.0 | 1.3% C | 1.3 | a | 20.0 | I | 1.5 | 6.25 |
| | HSS(2) | 97.9 | — | — | 1.0% Ni and 1.1% C | 2.1 | — | — | I | 1.5 | 6.50 |

TABLE 1-continued

| | | Composition of Ingredient Powder (% by mass) | | | | | | | Solid Lubricant Particle Powder | | |
|---|---|---|---|---|---|---|---|---|---|---|---|
| | | Pure Iron Powder | Ferroalloy Powder | | Alloy Element Powder | | Hard Particle Powder | | | | Green Compact Density |
| Samples | Section | Content | Type* | Content | Element | Content | Type** | Content | Type*** | Content (parts by weight)**** | (g/cm$^3$) |
| 11 | VSS(1) | 69.8 | — | — | 6.0% Ni, 3.0% Co, and 1.2% C | 10.2 | b | 20.0 | I | 0.5 | 6.15 |
| | HSS(2) | 97.4 | — | — | 1.5% Ni and 1.1% C | 2.6 | — | — | I | 1.5 | 6.50 |
| 12 | VSS(1) | 60.8 | — | — | 6.0% Ni, 4.0% Co, 3.0% Cu, and 1.2% C | 14.2 | c | 25.0 | II | 2.0 | 6.10 |
| | HSS(2) | 99.0 | — | — | 1.0% C | 1.0 | — | — | II | 2.0 | 6.55 |
| 13 | VSS(1) | 39.0 | B | 40.0 | 1.0% C | 1.0 | a | 20.0 | I | 1.5 | 6.25 |
| | HSS(2) | 81.0 | — | — | 6.0% Ni, 6.0% Co, 6.0% Cu, and 1.0% C | 19.0 | — | — | I | 2.0 | 6.10 |
| 14 | VSS(1) | 64.9 | F | 12.0 | 1.1% C | 1.1 | a | 22.0 | I | 1.0 | 6.55 |
| | HSS(2) | 80.8 | — | — | 6.0% Ni, 6.0% Co, 6.0% Cu, and 1.2% C | 19.2 | — | — | I | 2.0 | 6.10 |
| 15 | VSS(1) | 38.9 | C | 45.0 | 1.1% C | 1.1 | d | 15.0 | II | 1.0 | 7.15 |
| | HSS(2) | 98.9 | — | — | 1.1% C | 1.1 | — | — | I | 0.5 | 7.30 |
| 16 | VSS(1) | 38.8 | E | 40.0 | 1.2% C | 1.2 | a | 20.0 | I | 1.5 | 6.05 |
| | HSS(2) | 80.8 | — | — | 6.0% Ni, 6.0% Co, 6.0% Cu, and 1.2% C | 19.2 | | — | I | 2.0 | 6.10 |
| 17 | VSS(1) | 14.9 | D | 60.0 | 1.1% C | 1.1 | d | 24.0 | II | 1.0 | 6.70 |
| | HSS(2) | 88.9 | — | — | 6.0% Ni, 4.0% Cu, and 1.1% C | 11.1 | — | — | I | 2.0 | 7.20 |
| 18 | VSS(1) | 89.7 | A | 5.0 | 1.3% C | 1.3 | b | 4.0 | — | — | 6.15 |
| | HSS(2) | 89.0 | — | — | 2.0% Ni, 6.0% Co, 2.0% Cu, and 1.0% C | 11.0 | — | — | — | — | 6.40 |
| 19 | VSS(1) | 17.4 | B | 31.5 | 1.1% C | 1.1 | d | 50.0 | II | 2.5 | 6.05 |
| | HSS(2) | 97.0 | — | — | 2.0% Ni and 1.0% C | 3.0 | — | — | II | 3.0 | 6.45 |
| 20 | VSS(1) | 88.8 | — | — | 0.2% Ni and 1.0% C | 1.2 | b | 10.0 | I | 0.3 | 6.05 |
| | HSS(2) | 78.9 | — | — | 6.0% Ni, 6.0% Co, 8.0% Cu, and 1.1% C | 21.1 | — | — | I | 5.0 | 6.40 |
| 21 | VSS(1) | 61.0 | C | 20.0 | 1.0% C | 1.0 | b | 18.0 | II | 0.5 | 6.86 |
| | HSS(1) | 96.8 | — | — | 1.2% C, 1.5% Ni, and 0.5% Co | 3.2 | — | — | II | 1.0 | 7.00 |
| 22 | VSS(1) | 68.9 | E | 10.0 | 1.2% C | 1.2 | d | 20.0 | I | 1.0 | 6.75 |
| | HSS(1) | 97.4 | — | — | 1.1% C, and 1.5% Ni | 2.6 | — | — | I | 1.5 | 6.55 |

*Ferroalloy Powder
Type A: 1.0Cr—0.5Mn—0.3Mo—bal. Fe
Type B: 3.0Cr—0.2Mo—bal. Fe
Type C: 4.0Ni—1.5Cu—0.5Mo—bal. Fe
Type D: 1.5C—12Cr—1Mo—1V—bal. Fe (SKD11)
Type E: 0.8C—4Cr—5Mo—2V—6w—bal. Fe (SKH51)
Type F: 1.2C—4Cr—3Mo—10W—3V—10Co—bal. Fe (SKH57)
**Hard Particle Powder (Vickers Hardness)
Type a: Cr—Mo—Co Intermetallic Compound (950)
Type b: Ni—Cr—Mo—Co Intermetallic Compound (1,100)
Type c: Fe—Mo Hard Particles (1,100)
Type d: Fe—Ni—Mo—S Hard Particles (600)
***Solid Lubricant Particle Powder
Type I: MnS
Type II: $CaF_2$
****Parts by weight with respect to 100 parts by weight of the amount of the raw material powder containing the pure iron powder, ferroalloy powder, alloy element powder, and hard particle powder
(1)VSS represents a valve-seating section.
(2)HSS represents a head-seating section.

Each first raw material powder and second raw material powder (mixed powders) were filled into a metal mold one after another such that they form a double layer structure. The resulting powders were then compacted with a molding press, thereby forming a green compact. The density of the green compact was adjusted by varying the compacting conditions.

The green compact was sintered at 1,000–1,200° C. for 10–30 minutes in a protective atmosphere (gas obtained by the decomposition of ammonia), thereby obtaining a sintered body (an iron-based sintered alloy member).

Test pieces were cut from the obtained sintered body. The test pieces were measured for the composition of the matrix portion, porosity, and density of the sintered body. The porosity was determined with an image analysis system using each test piece having a polished surface. The valve-seating section and head-seating section were separately measured for the density by an Archimedes method.

Pieces obtained from the sintered body were machined by a cutting or grinding process into valve seats having an outer diameter of 33 mm, inner diameter of 29 mm, and thickness of 6.0 mm. The valve seats were separately subjected to a single body rig abrasion test in order to measure the abrasion resistance and an oxidation test in order to measure the amount of iron oxide.

(1) Single Body Rig Abrasion Test (Test for Measuring Abrasion Resistance)

Figure 5:
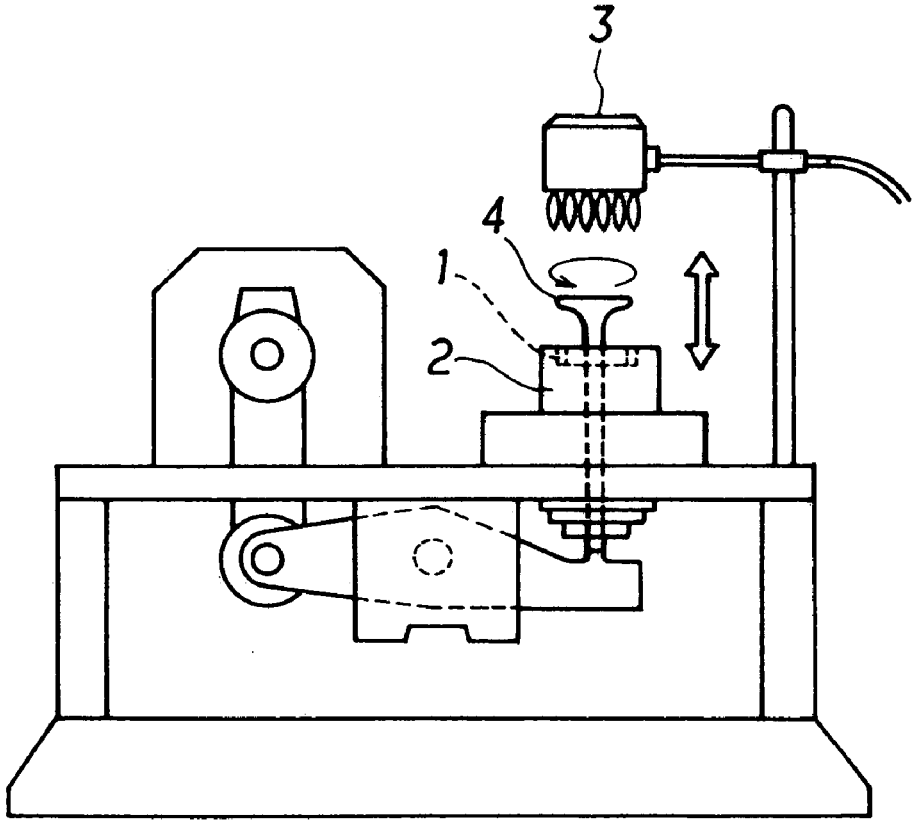
FIG. 5 is a schematic view showing a single body rig abrasion tester.

The single body rig abrasion test was performed using a test machine shown in FIG. 5. A valve seat 1 was press-fitted into a test jig 2, which corresponds to a cylinder head. A valve 4 was moved upward and downward with a crank while the valve seat 1 and valve 4 were heated with a heater 3, mounted on the test machine, using LPG and air. The abrasion was determined according to the valve sinkage. Test conditions are described below. Test Temperature: 400° C. (at a valve seat surface) Test Period: 9.0 hours Cam Rotations: 3,000 rpm Valve Rotations: 20 rpm Spring Load: 35 kgf (345 N) (in a setting step) Valve Material: SUH35 Lift: 9.0 mm (2) Oxidation Test (Test for Determining Amount of Iron Oxide)

Each valve seat was divided into a valve-seating section and head-seating section, which were sufficiently cleaned and degreased. The resulting valve-seating section, which is a test sample, was placed in a furnace, whereby the valve-seating section was heat-treated under the conditions below. Heating Temperature: 500° C. Heating Time: 10, 20, or 30 minutes Heating Atmosphere: Air Atmosphere The resulting valve-seating section measured for the weight, thereby determining an increase, represented by percent by weight, due to oxidation. The increase was calculated according to the following formula:

Increase due to Oxidation (%)={(Weight of Heat-treated Test Sample)−(Weight of Untreated Test Sample)}×100/(Weight of Untreated Test Sample).

Obtained results are shown in Table 2.

TABLE 2

| | | Sintered Body | | | | | | | | | |
|---|---|---|---|---|---|---|---|---|---|---|---|
| | | Composition of Base Portion (mass %) | | | | | | | | | Hard |
| Samples | Section | C | Ni | Cr | Mo | Cu | Co | Others | Element Amount | Remainder | Particles (area %) |
| 1 | VSS(1) | 1.0 | 11.7 | — | 4.4 | 0.7 | — | 0.1% Si and 0.4% S | 18.3 | Fe | 12.0 |
| | HSS(2) | 1.0 | — | — | — | 2.0 | — | — | 3.0 | Fe | — |
| 2 | VSS(1) | 1.1 | — | 2.2 | 3.0 | — | 6.0 | 0.1% V, 2.0% W, 0.1% S and 0.3% Si | 14.8 | Fe | 9.0 |
| | HSS(2) | 1.0 | 1.0 | — | — | — | — | — | 2.0 | Fe | — |
| 3 | VSS(1) | 1.2 | 8.0 | 4.8 | 4.8 | — | 11.0 | 0.4% Si | 30.2 | Fe | 18.0 |
| | HSS(2) | 1.0 | — | — | — | 1.5 | — | — | 2.5 | Fe | — |
| 4 | VSS(1) | 1.2 | 8.0 | 4.8 | 7.8 | — | 12.0 | 0.4% Si | 34.2 | Fe | 18.0 |
| | HSS(2) | 1.2 | 1.5 | — | — | — | 0.5 | — | 3.2 | Fe | — |
| 5 | VSS(1) | 1.1 | — | 0.4 | 10.9 | — | — | 0.3% Mn | 12.7 | Fe | 15.0 |
| | HSS(2) | 1.2 | 1.0 | — | — | 2.0 | — | — | 4.2 | Fe | — |
| 6 | VSS(1) | 1.2 | 6.0 | — | 12.0 | 3.0 | 4.0 | — | 26.2 | Fe | 18.0 |
| | HSS(2) | 1.1 | 1.0 | — | — | — | — | — | 2.1 | Fe | — |
| 7 | VSS(1) | 1.7 | 21.1 | 5.4 | 9.4 | — | — | 0.4% V, 0.2% Si, and 0.9% S | 39.1 | Fe | 29.0 |
| | HSS(2) | 1.2 | — | — | — | 1.0 | — | — | 2.2 | Fe | — |
| 8 | VSS(1) | 1.3 | 11.9 | 0.6 | 5.8 | — | — | 0.3% V, 0.9% W, 0.2% Si, and 0.5% S | 21.5 | Fe | 15.0 |
| | HSS(2) | 1.3 | — | — | — | 1.0 | — | — | 2.3 | Fe | — |
| 9 | VSS(1) | 1.2 | — | 2.4 | 6.7 | — | 14.3 | 0.4% V 1.1% W and 0.6% Si | 26.7 | Fe | 19.0 |
| | HSS(2) | 1.2 | — | — | — | 1.5 | — | — | 2.7 | Fe | — |
| 10 | VSS(1) | 1.3 | — | 2.9 | 5.8 | — | 12.0 | 0.1% V, 3.8% W, 0.1% S and 0.5% Si | 26.5 | Fe | 18.0 |
| | HSS(2) | 1.1 | 1.0 | — | — | — | — | — | 2.1 | Fe | — |
| 11 | VSS(1) | 1.2 | 8.0 | 4.8 | 4.8 | — | 11.0 | 0.4% Si | 30.2 | Fe | 18.0 |
| | HSS(2) | 1.1 | 1.5 | — | — | — | — | — | 2.6 | Fe | — |
| 12 | VSS(1) | 1.2 | 6.0 | — | 15.0 | 3.0 | 4.0 | — | 29.2 | Fe | 22.0 |
| | HSS(2) | 1.0 | — | — | — | — | — | — | 1.0 | Fe | — |
| 13 | VSS(1) | 1.0 | — | 2.9 | 5.8 | — | 12.0 | 0.1% V, 0.1% S and 0.5% Si | 22.4 | Fe | 18.0 |
| | HSS(2) | 1.0 | 6.0 | — | — | 6.0 | 6.0 | — | 19.0 | Fe | — |
| 14 | VSS(1) | 1.3 | — | 2.4 | 6.7 | — | 14.3 | 0.4% V, 1.1% W and 0.6% Si | 26.8 | Fe | 20.0 |
| | HSS(2) | 1.2 | 6.0 | — | — | 6.0 | 6.0 | — | 19.2 | Fe | — |
| 15 | VSS(1) | 1.1 | 11.7 | — | 4.4 | 0.7 | — | 0.1% Si and 0.4% S | 18.4 | Fe | 13.0 |
| | HSS(2) | 1.1 | — | — | — | — | — | — | 1.1 | Fe | — |
| 16 | VSS(1) | 1.6 | — | 3.3 | 7.7 | — | 12.0 | 0.8% V, 2.3% W, and 0.6% Si | 28.3 | Fe | 18.0 |
| | HSS(2) | 1.2 | 6.0 | — | — | 6.0 | 6.0 | — | 19.2 | Fe | — |
| 17 | VSS(1) | 2.0 | 15.8 | 7.2 | 7.3 | — | — | 0.5% V, 0.2% Si, and 0.6% S | 33.6 | Fe | 21.0 |
| | HSS(2) | 1.1 | 6.0 | — | — | 4.0 | — | — | 11.1 | Fe | — |
| 18 | VSS(1) | 1.3 | 0.4 | 1.0 | 1.0 | — | 1.6 | 0.1% Si | 5.4 | Fe | 3.0 |
| | HSS(2) | 1.0 | 2.0 | — | — | 2.0 | 6.0 | — | 11.0 | Fe | — |
| 19 | VSS(1) | 1.1 | 33.0 | 1.0 | 14.1 | — | — | 0.1% V, 0.4% Si, and 1.4% S | 51.1 | Fe | 45.0 |
| | HSS(2) | 1.0 | 2.0 | — | — | — | — | — | 3.0 | Fe | — |

TABLE 2-continued

| | | | | | | | | | | | |
|---|---|---|---|---|---|---|---|---|---|---|---|
| 20 | VSS[1] | 1.0 | 1.2 | 2.4 | 2.4 | — | 4.0 | 0.2% Si | 11.2 | Fe | 8.0 |
| | HSS[2] | 1.1 | 6.0 | — | — | 8.0 | 6.0 | — | 21.1 | Fe | — |
| 21 | VSS[1] | 1.0 | 2.6 | 4.3 | 4.4 | — | 7.2 | 0.4% Si | 19.9 | Fe | 12.0 |
| | HSS[1] | 1.2 | 1.5 | — | — | — | 0.5 | — | 3.2 | Fe | — |
| 22 | VSS[1] | 1.3 | 13.2 | 0.4 | 6.1 | — | — | 0.2% V, 0.6% W, 0.2% Si, and 0.5% S | 22.5 | Fe | 9.0 |
| | HSS[1] | 1.1 | 1.5 | — | — | — | — | — | 2.6 | Fe | — |

| | Sintered Body | | | Test Results: Single Body Rig Abrasion | | Test Results: Oxidation Test | | | |
|---|---|---|---|---|---|---|---|---|---|
| | | | | Test Abrasion (μm) | | Increase due to Oxidation (%) | | | |
| Samples | Solid Lubricant Particles (area %) | Porosity (volume %) | Sintered Density ($g/cm^3$) | Seat | Valve | 10 min | 20 min | 30 min | Remarks |
| 1 | 1.2 | 11.0 | 7.05 | 17 | 13 | 0.25 | 0.41 | 0.62 | Example |
| | 1.2 | 11.0 | 7.10 | | | | — | | |
| 2 | 1.8 | 17.0 | 6.55 | 17 | 9 | 0.34 | 0.49 | 0.68 | Example |
| | 1.2 | 11.0 | 7.10 | | | | — | | |
| 3 | 0.8 | 17.0 | 6.55 | 13 | 10 | 0.40 | 0.53 | 0.77 | Example |
| | 0.8 | 12.0 | 7.00 | | | | — | | |
| 4 | 1.2 | 19.0 | 6.50 | 11 | 9 | 0.45 | 0.58 | 0.82 | Example |
| | 1.2 | 12.0 | 7.00 | | | | — | | |
| 5 | 1.8 | 20.0 | 6.45 | 13 | 6 | 0.33 | 0.46 | 0.68 | Example |
| | 1.3 | 14.0 | 6.80 | | | | — | | |
| 6 | 1.2 | 20.0 | 6.40 | 12 | 12 | 0.42 | 0.58 | 0.78 | Example |
| | 1.3 | 15.0 | 6.80 | | | | — | | |
| 7 | 1.2 | 20.0 | 6.45 | 11 | 15 | 0.30 | 0.43 | 0.63 | Example |
| | 1.3 | 15.0 | 6.80 | | | | — | | |
| 8 | 2.3 | 20.0 | 6.40 | 16 | 8 | 0.38 | 0.52 | 0.76 | Example |
| | 1.3 | 17.0 | 6.60 | | | | — | | |
| 9 | 1.2 | 20.0 | 6.35 | 12 | 11 | 0.41 | 0.55 | 0.77 | Example |
| | 1.3 | 17.0 | 6.50 | | | | — | | |
| 10 | 1.7 | 24.0 | 6.15 | 13 | 8 | 0.44 | 0.56 | 0.79 | Example |
| | 1.5 | 19.0 | 6.50 | | | | — | | |
| 11 | 1.6 | 24.0 | 6.10 | 11 | 10 | 0.48 | 0.63 | 0.93 | Example |
| | 1.6 | 19.0 | 6.50 | | | | — | | |
| 12 | 2.3 | 24.0 | 6.10 | 12 | 14 | 0.48 | 0.65 | 0.92 | Example |
| | 2.3 | 19.0 | 6.50 | | | | — | | |
| 13 | 1.7 | 24.0 | 6.15 | 33 | 26 | 0.43 | 0.59 | 0.79 | Comparative Example |
| | 2.5 | 28.0 | 6.10 | | | | — | | |
| 14 | 1.2 | 20.0 | 6.45 | 25 | 20 | 0.38 | 0.55 | 0.76 | Comparative Example |
| | 2.5 | 28.0 | 6.10 | | | | — | | |
| 15 | 1.2 | 8.0 | 7.25 | 39 | 27 | 0.01 | 0.04 | 0.09 | Comparative Example |
| | 0.7 | 7.0 | 7.30 | | | | — | | |
| 16 | 1.8 | 30.0 | 6.00 | 51 | 22 | 0.40 | 0.59 | 0.87 | Comparative Example |
| | 2.5 | 28.0 | 6.10 | | | | — | | |
| 17 | 1.2 | 12.0 | 6.65 | 43 | 36 | 0.02 | 0.05 | 0.12 | Comparative Example |
| | 2.5 | 8.0 | 7.15 | | | | — | | |
| 18 | — | 26.0 | 6.12 | 55 | 21 | 0.36 | 0.54 | 0.82 | Comparative Example |
| | — | 20.0 | 6.35 | | | | — | | |
| 19 | 2.8 | 28.0 | 6.00 | 25 | 58 | 0.39 | 0.56 | 0.81 | Comparative Example |
| | 3.6 | 22.0 | 6.35 | | | | — | | |
| 20 | 0.5 | 28.0 | 6.05 | 54 | 25 | 0.48 | 0.62 | 0.86 | Comparative Example |
| | 6.5 | 22.0 | 6.35 | | | | — | | |
| 21 | 1.2 | 14.0 | 6.75 | 16 | 13 | 0.26 | 0.52 | 0.78 | Example |
| | 1.5 | 13.0 | 6.95 | | | | — | | |
| 22 | 1.8 | 16.0 | 6.80 | 17 | 8 | 0.33 | 0.52 | 0.75 | Example |
| | 2.0 | 17.0 | 6.50 | | | | — | | |

[1]VSS represents a valve-seating section.
[2]HSS represents a head-seating section.

In Samples No. 1–12, No. 21, No. 22, which are examples of the present invention, the abrasion of the valve seats ranges from 11 to 17 μm and the abrasion of counter members thereof, which are the valves, ranges from 6 to 15 μm. Furthermore, the increase due to oxidation at a predetermined temperature for a predetermined period is large. This means that the valve seats have satisfactory abrasion resistance and iron oxide-forming properties. In contrast, in Samples No. 13–20, which are comparative examples that are out of the scope of the present invention, the abrasion of the valve seats ranges from 25 to 55 μm and the abrasion of counter members thereof ranges from 20 to 58 μm, that is, the abrasion resistance is lower and the opposite aggressibility is higher as compared with the valve seats of the examples. Furthermore, the increase due to oxidation varies and is not large. This means that the valve seats of the comparative examples do not have both satisfactory abrasion resistance and iron oxide-forming properties.

Exemplary structures of the obtained valve seats are shown in FIGS. 2 to 4.

Figure 2A:
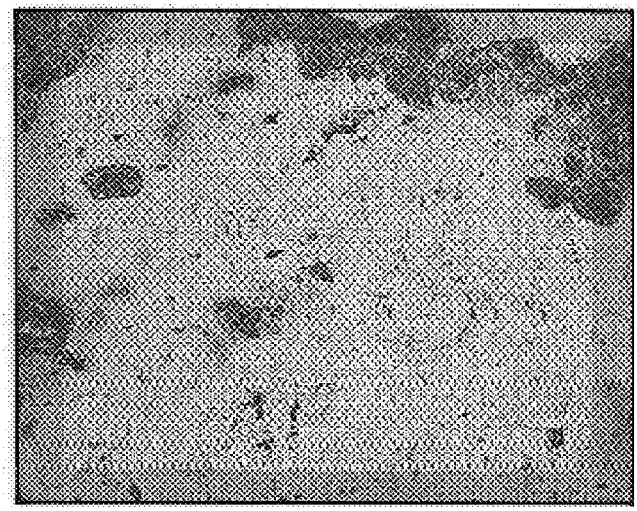
FIG. 2A shows the optical micrograph of a matrix portion present in a valve-seating section of Sample 1, which is an example of the present invention.
Figure 2B:
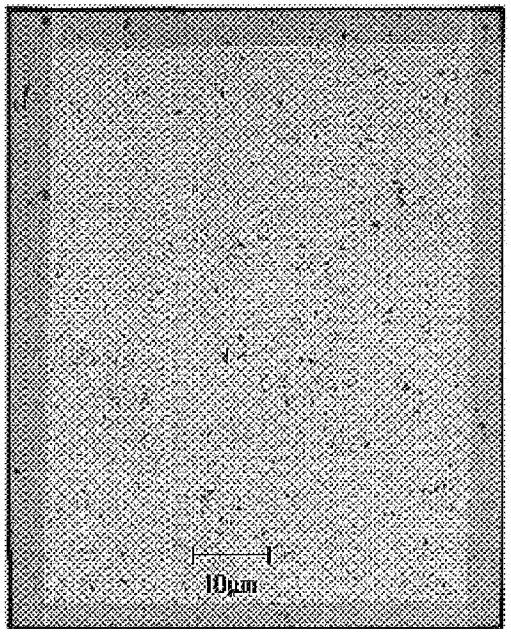
FIG. 2B shows the optical micrograph of the matrix phase included in a head-seating section of Sample 1.

FIG. 2 includes two optical micrographs: FIG. 2A shows the structure of a matrix portion of the valve-seating section of Sample 1, which is an example of the present invention, and FIG. 2B shows the structure of the matrix phase of the head-seating section of Sample 1.

Figure 3A:
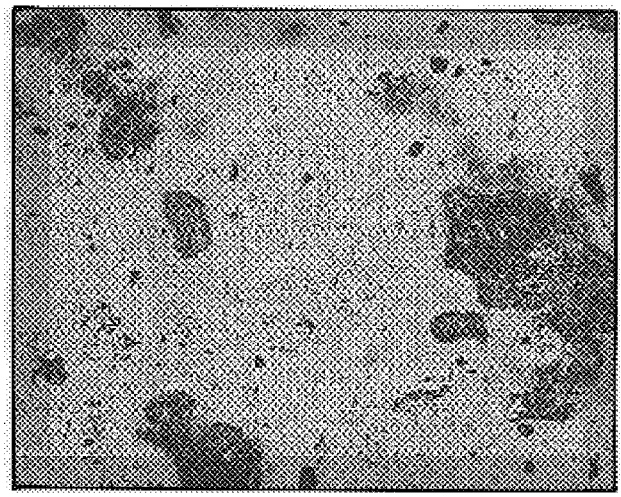
FIG. 3A shows the optical micrograph of a matrix portion present in a valve-seating section of Sample 5, which is an example of the present invention.
Figure 3B:
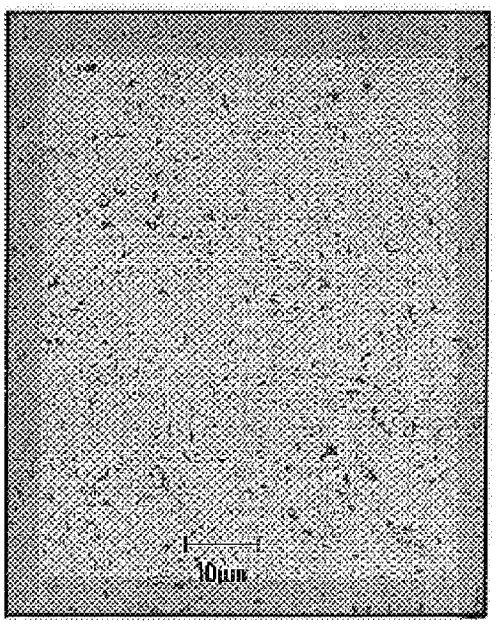
FIG. 3B shows the optical micrograph of the matrix phase included in a head-seating section of Sample 5.

FIG. 3 includes two optical micrographs: FIG. 3A shows the structure of a matrix portion present in the valve-seating section of Sample 5, which is an example of the present invention, and FIG. 3B shows the structure of the matrix phase in the head-seating section of Sample 5.

Figure 4A:
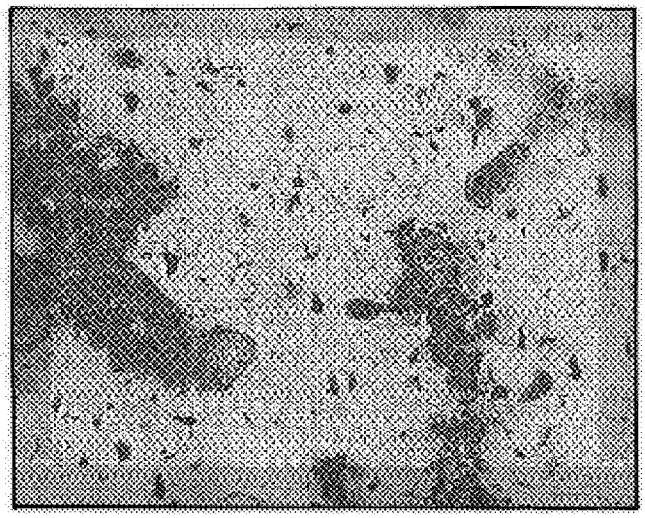
FIG. 4A shows the optical micrograph of a matrix portion present in a valve-seating section of Sample 16, which is a comparative example of the present invention.
Figure 4B:
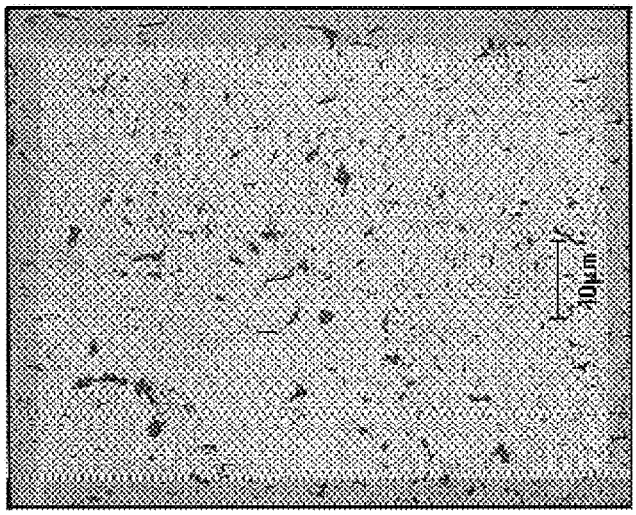
FIG. 4B shows the optical micrograph of the matrix phase included in a head-seating section of Sample 16.

FIG. 4 includes two optical micrographs: FIG. 4A shows the structure of a matrix portion present in the valve-seating section of Sample 16, which is a comparative example of the present invention, and FIG. 4B shows the structure of the matrix phase in the head-seating section of Sample 16.

What is claimed is:

1. A valve seat, press-fitted into a cylinder head of an internal combustion engine containing an iron-based sintered alloy, comprising:

a valve-seating section; and a head-seating section.

wherein the valve-seating section and the head-seating section are monolithically formed by a sintering process and form a double layer structure. the valve-seating section includes a first iron-based sintered alloy member that has a porosity of 10 to 25 percent by volume and a sintered density of 6.1 to 7.1 g/cm$^3$ and contains hard particles dispersed in a matrix phase, and the head-seating section includes a second iron-based sintered alloy member that has a porosity of 10 to 20 percent by volume and a sintered density of 6.4 to 7.1 g/cm$^3$, wherein the hard particles contain at least one selected from the group consisting of C, Cr, Mo, Co, Si, Ni, S, and Fe, and the content of the hard particles in the first iron-based sintered alloy member is 5 to 40 percent by area.

2. A valve seat, press-fitted into a cylinder head of an internal combustion engine, containing an iron-based sintered alloy, comprising:

a valve-seating section; and a head-seating section, wherein the valve-seating section and the head-seating section are monolithically formed by a sintering process and form a double layer structure, the valve-seating section includes a first iron-based sintered alloy member that has a porosity of 10 to 25 percent by volume and a sintered density of 6.1 to 7.1 g/cm$^3$ and contains hard particles dispersed in a matrix phase, and the head-seating section includes a second iron-based sintered alloy member that has a porosity of 10 to 20 percent by volume and a sintered density of 6.4 to 7.1 g/cm$^3$, wherein the matrix phase and hard particles form a base portion; the base portion contains 10.0 to 40.0 percent by mass of at least one selected from the group consisting of Ni, Cr, Mo, Cu, Co, V, Mn, W, C, Si, and S, the Ni content being 2.0 to 23.0%, the Cr content being 0.4 to 15.0%, the Mo content being 3.0 to 15.0%, the Cu content being 0.2 to 3.0%, the Co content being 3.0 to 15.0%, the V content being 0.1 to 0.5%, the Mn content being 0.1 to 0.5%, the W content being 0.2 to 6.0%, the C content being 0.8 to 2.0%, the Si content being 0.1 to 1.0%, the S content being 0.1 to 1.0% on a mass basis, the balance being substantially Fe; and the matrix phase of the second iron-based sintered alloy member contains 0.3–15.0 percent by mass of at least one selected from the group consisting of C, Ni, Cr, Mo, Cu, Co, V, and Mn, the balance being substantially Fe.

3. A valve seat, press-fitted into a cylinder head of an internal combustion engine, containing an iron-based sintered alloy, comprising:

a valve-seating section; and a head-seating section, wherein the valve-seating section and the head-seating section are monolithically formed by a sintering process and form a double layer structure, the valve-seating section includes a first iron-based sintered alloy member that has a porosity of 10 to 25 percent by volume and a sintered density of 6.1 to 7.1 g/cm$^3$ and contains hard particles dispersed in a matrix phase, and the head-seating section includes a second iron-based sintered alloy member that has a porosity of 10 to 20 percent by volume and a sintered density of 6.4 to 7.1 g/cm$^3$, wherein the hard particles contain at least one selected from the group consisting of C, Cr, Mo, Co, Si, Ni, S, and Fe, and the content of the hard particles in the first iron-based sintered alloy member is 5 to 40 percent by area, wherein the matrix phase and hard particles form a base portion; the base portion contains 10.0 to 40.0 percent by mass of at least one selected from the group consisting of Ni, Cr, Mo, Cu, Co, V, Mn, W, C, Si, and S, the Ni content being 2.0 to 23.0%, the Cr content being 0.4 to 15.0%, the Mo content being 3.0 to 15.0%, the Cu content being 0.2 to 3.0%, the Co content being 3.0 to 15.0%, the V content being 0.1 to 0.5%, the Mn content being 0.1 to 0.5%, the W content being 0.2 to 6.0%, the C content being 0.8 to 2.0%, the Si content being 0.1 to 1.0%, the S content being 0.1 to 1.0% on a mass basis, the balance being substantially Fe; and the matrix phase of the second iron-based sintered alloy member contains 0.3–15.0 percent by mass of at least one selected from the group consisting of C, Ni, Cr, Mo, Cu, Co, V, and Mn, the balance being substantially Fe.

4. The valve seat according to any one of claims 1, 2 or 3, wherein the first and second iron-based sintered alloy members further contain 0.3 to 3.5 percent by area of solid lubricant particles dispersed in the matrix phase.

5. The valve seat according to claim 4, wherein the solid lubricant particles contain at least one selected from the group consisting of a sulfide, and a fluoride.

6. A method for manufacturing a valve seat containing an iron-based sintered alloy, comprising:

a forming step of filling a first raw material powder for forming a valve-seating section and a second raw material powder for forming a head-seating section into a metal mold one after another such that the first and second raw material powders form a double layer structure and then compacting the resulting first and second raw material powders to form a green compact consisting of two layers; and a sintering step of heating the resulting green compact in a protective atmosphere to obtain a sintered body having a double layer construction, wherein the first raw material powder contains 20 to 70% of a pure iron powder, 10 to 50% of a first ferroalloy powder, and 5 to 40% of a hard particle powder on a mass basis or further contains 0.2 to 3.0 parts by weight of a solid lubricant particle powder with respect to 100 parts by weight of the first raw material powder, the pure iron powder, first ferroalloy powder, and hard particle powder or solid lubricant particle powder being blended and mixed; the first ferroalloy powder contains 3 to 30 percent by mass of at least one selected from the group consisting of Ni, Cr, Mo, Cu, Co, V, Mn, W, and C, the balance being substantially Fe; the hard particle powder contains at least one selected from the group consisting of C, Cr, Mo, Co, Si, Ni, S, and Fe; the second raw material powder contains 85% or more of the pure iron powder and 0.3 to 15% of a second ferroalloy powder on a mass basis or further contains 0.2 to 3.0 parts by weight of the solid lubricant particle powder with respect to 100 parts by weight of the second raw material powder, the pure iron powder and second ferroalloy powder or solid lubricant particle powder being blended and mixed; the second ferroalloy powder contains at least one selected from the group consisting of C, Ni, Cr, Mo, Cu, Co, V, and Mn; and conditions of the forming step and sintering step are adjusted such that the first iron-based sintered alloy member has a sintered density of 6.1 to 7.1 g/cm$^3$ and a porosity of 10 to 25 percent by volume and the second iron-based sintered alloy member has a sintered density of 6.4 to 7.1 g/cm$^3$ and a porosity of 10 to 20 percent by volume.

7. The method according to claim 6, wherein the first raw material powder contains 0.3 to 15 percent by mass of an alloy element powder instead of part or the whole of the ferroalloy powder, and the alloy element powder contains at least one selected from the group consisting of Ni, Cr, Mo, Cu, Co, V, Mn, W, and C.

* * * * *